US009182161B2

(12) United States Patent
Matsukura et al.

(10) Patent No.: US 9,182,161 B2
(45) Date of Patent: Nov. 10, 2015

(54) TURBO REFRIGERATION UNIT, CONTROL DEVICE THEREFOR, AND CONTROL METHOD THEREFOR

(75) Inventors: Noriyuki Matsukura, Tokyo (JP); Kenji Ueda, Tokyo (JP); Seiichi Okuda, Tokyo (JP); Tatsuru Nagai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 606 days.

(21) Appl. No.: 13/640,349

(22) PCT Filed: Sep. 16, 2011

(86) PCT No.: PCT/JP2011/071278

§ 371 (c)(1),
(2), (4) Date: Oct. 10, 2012

(87) PCT Pub. No.: WO2012/043283

PCT Pub. Date: Apr. 5, 2012

(65) Prior Publication Data

US 2013/0025306 A1 Jan. 31, 2013

(30) Foreign Application Priority Data

Sep. 30, 2010 (JP) ..... 2010-222501

(51) Int. Cl.
*G05D 23/32* (2006.01)
*F25B 19/00* (2006.01)
(Continued)

(52) U.S. Cl.
CPC ..... *F25B 41/04* (2013.01); *F25B 49/02* (2013.01); *F25B 2400/04* (2013.01);
(Continued)

(58) Field of Classification Search
CPC ..... F25B 41/04; F25B 49/02; F25B 2400/04; F25B 2400/0401; F25B 2400/13; F25B 2500/26; F25B 2500/28; F25B 2600/2501; F25B 2600/2509; F25B 2600/2513; F25B 2700/21171; F25B 2700/1933; F25B 2700/2103; F25B 2700/21151; F25B 2700/21152; F25B 2700/21161; F25B 2700/1931
USPC ..... 62/196.2, 196.4, 197, 79, 175, 127, 62/157, 158, 231
See application file for complete search history.

(56) References Cited

U.S. PATENT DOCUMENTS 6,474,087 B1 * 11/2002 Lifson ..... 62/199
2009/0031740 A1 * 2/2009 Douglas ..... 62/225

FOREIGN PATENT DOCUMENTS

CN 1550734 A 12/2004
CN 1280597 C 10/2006
(Continued)

OTHER PUBLICATIONS

Chinese Office Action dated Aug. 12, 2014, issued in corresponding CN application No. 201180020885.6 with English translation (18 pages).
(Continued)

*Primary Examiner* — Mohammad M Ali
*Assistant Examiner* — Daniel C Comings
(74) *Attorney, Agent, or Firm* — Westerman, Hattori, Daniels & Adrian, LLP

(57) ABSTRACT

An object is to provide a turbo-refrigeration-unit control device capable of achieving stable operation and reducing the amount of refrigerant. Provided is a control device for controlling a turbo refrigeration unit that includes a centrifugal compressor, a first-non-refrigerant pump for supplying a first non-refrigerant, a condenser that performs heat exchange between the first non-refrigerant and a refrigerant, an expansion valve that expands the refrigerant, a second-non-refrigerant pump for supplying a second non-refrigerant, an evaporator that performs heat exchange between the second non-refrigerant and the refrigerant, a bypass circuit that is used to inject part of the refrigerant from a discharge port of the centrifugal compressor into a suction port of the centrifugal compressor, and a bypass-circuit control valve that controls the flow rate of the refrigerant.

6 Claims, 10 Drawing Sheets

(51) Int. Cl.

| | |
|---|---|
| ***F25B 41/00*** | (2006.01) |
| ***F25B 49/00*** | (2006.01) |
| ***F25B 41/04*** | (2006.01) |
| ***F25B 49/02*** | (2006.01) |

(52) U.S. Cl.

CPC ..... *F25B 2400/13* (2013.01); *F25B 2500/26* (2013.01); *F25B 2500/28* (2013.01); *F25B 2600/2501* (2013.01); *F25B 2600/2509* (2013.01); *F25B 2600/2513* (2013.01); *F25B 2700/1931* (2013.01); *F25B 2700/1933* (2013.01); *F25B 2700/2103* (2013.01); *F25B 2700/21151* (2013.01); *F25B 2700/21152* (2013.01); *F25B 2700/21161* (2013.01); *F25B 2700/21171* (2013.01)

(56) References Cited

FOREIGN PATENT DOCUMENTS

| | | | |
|---|---|---|---|
| JP | 03-105156 | A | 5/1991 |
| JP | 04-052466 | A | 2/1992 |
| JP | 5-34023 | A | 2/1993 |
| JP | 5-288438 | A | 11/1993 |
| JP | 07-190507 | A | 7/1995 |
| JP | 2006-234363 | A | 9/2006 |
| JP | 2006-329557 | A | 12/2006 |
| JP | 2007-138919 | A | 6/2007 |
| JP | 2009-092309 | A | 4/2009 |
| JP | 2009-138973 | A | 6/2009 |
| JP | 2010-210146 | A | 9/2010 |

OTHER PUBLICATIONS

International Search Report of PCT/JP2011/071278; mailing date Dec. 20, 2011.

Written Opinion of PCT/JP2011/071278; mailing date Dec. 20, 2011.

Korean Notice of Allowance dated Aug. 27, 2014, issued in Korean Patent Application No. 2012-7027965, (2 pages), The Notice of Allowance has been received.

* cited by examiner

FIG. 9

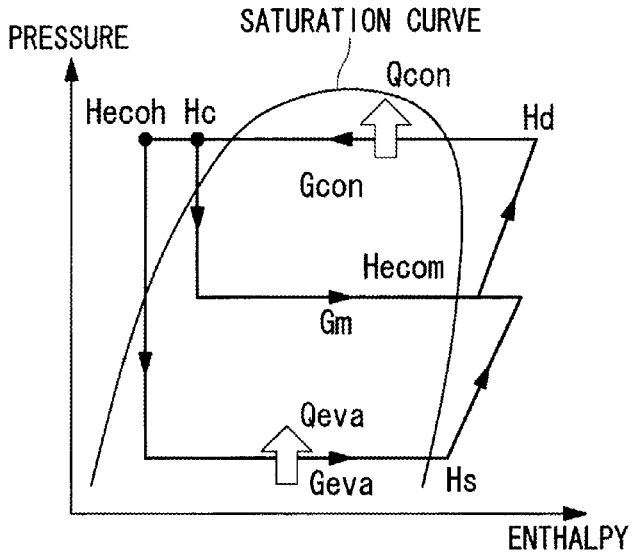

Hc=(B*Hd-A*Hecom)/(B-A)

A=Qcon/Geva
B=Hecom-Hecoh
Qcon=Gwh*Cwh*ΔTwh
Geva=Qeva/(Hs-Hecoh)
Qeva=Gwc*Cwc*ΔTwc Hs : COMPRESSOR SUCTION ENTHALPY [kJ/kg]
Hd : COMPRESSOR DISCHARGE ENTHALPY [kJ/kg]
Hc : CONDENSER OUTLET ENTHALPY [kJ/kg]
Hecoh : ECONOMIZER HIGH-PRESSURE OUTLET ENTHALPY [kJ/kg]
Hecom : ECONOMIZER MEDIUM-PRESSURE OUTLET ENTHALPY [kJ/kg]
Qcon : CONDENSER EXCHANGED-HEAT AMOUNT [kW]
Qeva : EVAPORATOR EXCHANGED-HEAT AMOUNT [kW]
Gcon : CONDENSER REFRIGERANT FLOW RATE [kg/s]
Geva : EVAPORATOR REFRIGERANT FLOW RATE [kg/s]
Gm : INTERMEDIATE SUCTION FLOW RATE [kg/s]
Gwh : HEATED-WATER FLOW RATE [m3/s]
Gwc : HEAT-SOURCE WATER FLOW RATE [m3/s]
Cwh : HEATED-WATER SPECIFIC HEAT [kJ/kg/K]
Cwc : HEAT-SOURCE WATER SPECIFIC HEAT [kJ/kg/K]
ΔTwh : HEATED-WATER INLET AND OUTLET TEMPERATURE DIFFERENCE [°C]
ΔTwc : HEAT-SOURCE WATER INLET AND OUTLET TEMPERATURE DIFFERENCE [°C]

TURBO REFRIGERATION UNIT, CONTROL DEVICE THEREFOR, AND CONTROL METHOD THEREFOR

TECHNICAL FIELD

The present invention relates to a turbo refrigeration unit, a control device therefor, and a control method therefor, and particularly, to a turbo-refrigeration-unit control device that is capable of stably operating the turbo refrigeration unit and of reducing the amount of circulating refrigerant.

BACKGROUND ART

As shown in FIG. 10, a conventional turbo refrigeration unit 100 includes a centrifugal compressor 103, an oil-mist separation tank 102 that separates oil from a high-pressure gas refrigerant compressed by the centrifugal compressor 103, a condenser 105 that condenses the high-pressure gas refrigerant from which oil has been separated by the oil-mist separation tank 102, a high-stage expansion valve 107 that expands a high-pressure liquid refrigerant condensed by the condenser 105, an intercooler 106 that cools the liquid refrigerant expanded by the high-stage expansion valve 107, a low-stage expansion valve 108 that expands the liquid refrigerant cooled by the intercooler 106, an evaporator 109 that evaporates the low-pressure liquid refrigerant expanded by the low-stage expansion valve 108, and a gas-liquid separator 110 that separates the evaporated refrigerant into a gas refrigerant and a liquid refrigerant.

The centrifugal compressor 103 is rotationally driven by an electric motor 111 via a gear 101 to suction and compress the refrigerant. The high-pressure gas refrigerant compressed by the centrifugal compressor 103 reaches about 100° C., for example, and is guided to the oil-mist separation tank 102. From the high-pressure gas refrigerant guided to the oil-mist separation tank 102, oil is separated through centrifugal separation (for example, see PTLs (Patent Literatures) 1 to 4). The high-pressure gas refrigerant from which oil has been separated is guided to the shell-and-tube condenser 105, where it is subjected to heat exchange with heated water of 90° C., for example.

The high-pressure liquid refrigerant condensed in the condenser 105 through heat exchange with the heated water is expanded by passing through the high-stage expansion valve 107, which is provided at a downstream side of the condenser 105. The liquid refrigerant expanded by the high-stage expansion valve 107 is guided to the self-expansion-type intercooler 106.

Furthermore, a gas-phase part of the refrigerant guided to the intercooler 106 is guided to an intermediate stage of the centrifugal compressor 103.

The liquid refrigerant self-expanded in the intercooler 106 is guided to the low-stage expansion valve 108, where it is expanded. The expanded low-pressure liquid refrigerant is guided to the shell-and-tube evaporator 109, where it is evaporated through heat exchange with heat-source water of 40° C., for example. The refrigerant evaporated in the evaporator 109 is guided to the gas-liquid separator 110 and is separated into a gas refrigerant and a liquid refrigerant in the gas-liquid separator 110. The gas refrigerant obtained in the gas-liquid separator 110 is guided to the centrifugal compressor 103, where it is compressed.

Furthermore, part of the high-pressure gas refrigerant from which oil has been separated is guided from the oil-mist separation tank 102 to the gas-liquid separator 110 via a hot-gas bypass valve 112. The hot-gas bypass valve 112 controls the flow rate of the high-pressure gas refrigerant to be guided to the gas-liquid separator 110. The liquid refrigerant guided from a portion between the intercooler 106 and the low-stage expansion valve 108 merges at the downstream side of the hot-gas bypass valve 112 via a liquid injection valve 113. The liquid injection valve 113 controls the flow rate of the liquid refrigerant.

The high-pressure gas refrigerant that has passed through the hot-gas bypass valve 112 and the liquid refrigerant from the liquid injection valve 113 are injected into the gas-liquid separator 110. Thus, in the gas-liquid separator 110, the liquid refrigerant and the gas refrigerant whose temperatures are reduced to 40° C. to 50° C., for example, are separately obtained. In this way, by guiding the reduced-temperature gas refrigerant to an inlet of the centrifugal compressor 103, the load on the centrifugal compressor 103 is controlled.

CITATION LIST

Patent Literature

{PTL 1} Japanese Unexamined Patent Application, Publication No. 2006-329557

{PTL 2} Japanese Unexamined Patent Application, Publication No. 2006-234363

{PTL 3} Japanese Unexamined Patent Application, Publication No. 2007-138919

{PTL 4} Japanese Unexamined Patent Application, Publication No. 2009-138973

{PTL 5} Japanese Unexamined Patent Application, Publication No. 2009-92309

SUMMARY OF INVENTION

Technical Problem

However, in the configuration shown in FIG. 10, a large amount of filled refrigerant is required because the inner volume of the turbo refrigeration unit 100 is large. Thus, even if the pressure of the refrigerant is reduced to a specified pressure or below in order to recover the refrigerant, the refrigerant that cannot be recovered remains in the condenser 105, the evaporator 109, the intercooler 106, and the gas-liquid separator 110, and the refrigerant remaining in those devices is eventually discharged into the atmosphere. In order to reduce the amount of such refrigerant that cannot be recovered and to minimize the amount of leakage of the refrigerant, a reduction in the amount of filled refrigerant used for the turbo refrigeration unit 100 is demanded.

However, when the amount of filled refrigerant is reduced, an uneven flow of the refrigerant circulating in the turbo refrigeration unit 100 is caused, the refrigerant remains in the evaporator 109, etc., and a liquid-phase refrigerant is discharged from the evaporator 109, in some cases. If the liquid-phase refrigerant discharged from the evaporator 109 is suctioned into the centrifugal compressor 103, there is a problem in that the centrifugal compressor 103 will be damaged.

The present invention has been made in view of such circumstances, and an object thereof is to provide a turbo refrigeration unit, a control device therefor, and a control method therefor capable of achieving stable operation and reducing the amount of refrigerant.

Solution to Problem

In order to achieve the above-described object, the present invention provides the following solutions.

According to a first aspect, the present invention provides a turbo-refrigeration-unit control device that controls a turbo refrigeration unit, the turbo refrigeration unit including: a centrifugal compressor that compresses a refrigerant; a condenser that condenses a high-pressure gas refrigerant through heat exchange with a first non-refrigerant supplied by a first-non-refrigerant pump; an expansion valve that expands a liquid refrigerant derived from the condenser; an evaporator in which the expanded liquid refrigerant evaporates through heat exchange with a second non-refrigerant supplied by a second-non-refrigerant pump; a bypass-circuit control valve that is provided in a bypass circuit used to inject part of the high-pressure gas refrigerant compressed by the centrifugal compressor into a suction port of the centrifugal compressor and that controls the flow rate of the high-pressure gas refrigerant; a compressor-suction-port pressure measurement unit for measuring a suction pressure of the gas refrigerant at the centrifugal compressor; and a second-non-refrigerant outlet temperature measurement unit for measuring an outlet temperature of the second non-refrigerant at the evaporator, in which, when the turbo refrigeration unit is started-up, the expansion valve is controlled so as to be closed; the first-non-refrigerant pump and the second-non-refrigerant pump are operated; the centrifugal compressor is started-up; and then the degree-of-opening of the bypass-circuit control valve is controlled such that the temperature difference between a suction saturation temperature at the centrifugal compressor and the outlet temperature of the second non-refrigerant becomes equal to or less than a predetermined temperature difference.

In a turbo refrigeration unit using a centrifugal compressor, there is a problem in that, when the turbo refrigeration unit is started-up, a liquid refrigerant remaining in the evaporator without evaporating is suctioned into the centrifugal compressor, thus making it difficult to continue stable operation of the turbo refrigeration unit.

Therefore, in first aspect of the present invention, attention is focused on the fact that, when the liquid refrigerant remains in the evaporator, the liquid refrigerant evaporates, increasing the gas-phase-refrigerant occupancy in the evaporator, and contact between the second non-refrigerant and the liquid refrigerant is reduced, thus reducing the heat to be transferred from the second non-refrigerant to the refrigerant and increasing the temperature difference between the suction saturation temperature at the centrifugal compressor and the outlet of the second non-refrigerant. Specifically, when the turbo refrigeration unit is started-up, the control device closes the expansion valve and controls the degree-of-opening of the bypass-circuit control valve, which guides part of the compressed high-pressure gas refrigerant derived from the centrifugal compressor to the suction port of the centrifugal compressor, such that the temperature difference between the suction saturation temperature at the centrifugal compressor and the outlet temperature of the second non-refrigerant becomes equal to or less than the predetermined temperature difference. Thus, the amount of liquid refrigerant remaining in the evaporator can be reduced. Therefore, when the turbo refrigeration unit is started-up, stable operation can be achieved.

Note that the suction saturation temperature at the centrifugal compressor can be calculated from the suction pressure at the centrifugal compressor.

According to the turbo-refrigeration-unit control device of the above-described aspect, when the turbo refrigeration unit is started-up, the expansion valve is controlled so as to be closed; the first-non-refrigerant pump is operated; the centrifugal compressor is started-up; the degree-of-opening of the bypass-circuit control valve is controlled; and then the second-non-refrigerant pump is operated.

When the turbo refrigeration unit is started-up, if the operation of the second-non-refrigerant pump is started before the centrifugal compressor is started-up, the second non-refrigerant having a temperature higher than a predetermined outlet temperature is output from the evaporator, in some cases.

Therefore, in the above-described aspect, the control device, which starts the operation of the second-non-refrigerant pump after the expansion valve is closed and the suction saturation temperature at the centrifugal compressor becomes equal to or lower than the predetermined temperature, is used. Thus, when the turbo refrigeration unit is started-up, it is possible to reduce the temperature of the second non-refrigerant output from the evaporator. Therefore, it is possible to output the second non-refrigerant having a predetermined outlet temperature from the evaporator.

According to the turbo-refrigeration-unit control device of the above-described aspect, the turbo refrigeration unit further includes: a liquid-refrigerant injection control valve that is provided in an injection circuit that is used to inject part of the liquid refrigerant into the suction port of the centrifugal compressor and that controls the flow rate of the liquid refrigerant; and a compressor-discharge-port temperature measurement unit for measuring a discharge-port temperature of the high-pressure gas refrigerant at the centrifugal compressor, in which the degree-of-opening of the liquid-refrigerant injection control valve is controlled based on the outlet temperature at the centrifugal compressor.

The control device, which controls the degree-of-opening of the liquid-refrigerant injection control valve based on the outlet temperature at the centrifugal compressor, is used. Thus, it is possible to control the temperature of the gas refrigerant to be guided to the suction port of the centrifugal compressor by injecting a low-temperature liquid refrigerant into a high-temperature high-pressure gas refrigerant guided from the bypass circuit. Therefore, the temperature of the refrigerant to be guided to the suction port of the centrifugal compressor can be reduced.

According to the turbo-refrigeration-unit control device of the above-described aspect, the turbo refrigeration unit further includes: an economizer that performs heat exchange between an intermediate-pressure refrigerant that has evaporated by expanding and the liquid refrigerant condensed by the condenser and that injects the intermediate-pressure refrigerant into an intermediate suction port of the centrifugal compressor; a first-non-refrigerant flow-rate measurement unit for measuring the flow rate of the first non-refrigerant at the condenser; a second-non-refrigerant flow-rate measurement unit for measuring the flow rate of the second non-refrigerant at the evaporator; a first-non-refrigerant inlet temperature measurement unit for measuring an inlet temperature of the first non-refrigerant at the condenser; a second-non-refrigerant inlet temperature measurement unit for measuring an inlet temperature of the second non-refrigerant at the evaporator; a first-non-refrigerant outlet temperature measurement unit for measuring an outlet temperature of the first non-refrigerant at the condenser; an economizer outlet temperature measurement unit for measuring an outlet temperature at the economizer of the liquid refrigerant that has been subjected to heat exchange with the intermediate-pressure refrigerant; a first expansion valve that expands part of the liquid refrigerant derived from the condenser to change it to the intermediate-pressure refrigerant; and a second expansion valve that expands the liquid refrigerant that has been subjected to heat exchange with the intermediate-pressure refrigerant in the economizer, in which, when the turbo refrigeration unit is started-up, the degree-of-opening of the second expansion valve is controlled based on the outlet temperature at the economizer; and the degree-of-opening of the first expansion valve is controlled based on the flow rates of the first non-refrigerant and the second non-refrigerant, the inlet temperatures and the outlet temperatures of the first non-refrigerant and the second non-refrigerant, and the suction pressure at the centrifugal compressor.

When the turbo refrigeration unit is operated, the control device, which controls the degree-of-opening of the second expansion valve based on the outlet temperature at the economizer and which controls the degree-of-opening of the first expansion valve based on inlet temperatures and the outlet temperatures of the first non-refrigerant and the second non-refrigerant and the suction pressure at the centrifugal compressor, is used. Thus, the amount of heat at the evaporator inlet can be controlled according to the amount of refrigerant circulating in the turbo refrigeration unit. As a result, it is possible to avoid a situation in which the liquid refrigerant is discharged from the evaporator, by overheating at the evaporator outlet. Therefore, stable operation of the turbo refrigeration unit can be achieved.

According to a second aspect, the present invention provides a turbo refrigeration unit including one of the above-described control devices.

The control device, which can reduce the amount of liquid refrigerant remaining in the evaporator, is used. Therefore, stable operation of the turbo refrigeration unit can be achieved.

Furthermore, when the amount of refrigerant circulating in the turbo refrigeration unit is reduced, heat exchangers with large inner volumes, such as a condenser, an economizer, and an evaporator, have been conventionally used in order to prevent the refrigerant from flowing unevenly. Furthermore, in order to separate the liquid refrigerant to be guided to the centrifugal compressor, a gas-liquid separator with a large inner volume has been provided at the upstream side of the suction port of the centrifugal compressor.

However, in the second aspect of the present invention, by using the control device, which controls the first-non-refrigerant pump, the second-non-refrigerant pump, the bypass-circuit control valve, the centrifugal compressor, and the control vale, it is possible to make the temperature difference between the suction saturation temperature at the centrifugal compressor and the outlet temperature of the second non-refrigerant equal to or less than the predetermined temperature difference. Thus, it is possible to reduce the amount of liquid refrigerant remaining in the evaporator and to achieve stable operation when the turbo refrigeration unit is started-up. Thus, the inner volumes of the condenser, the economizer, and the evaporator can be reduced. Therefore, it is possible to reduce the inner volume of the whole turbo refrigeration unit, thus reducing the amount of circulating refrigerant, and to achieve stable operation of the turbo refrigeration unit.

Furthermore, since the liquid refrigerant remaining in the condenser can be prevented from being guided to the suction port of the centrifugal compressor, it is possible to reduce the inner volume of the gas-liquid separator or to eliminate the gas-liquid separator.

According to a third aspect, the present invention provides a control method for a turbo refrigeration unit equipped with: a centrifugal compressor that compresses a refrigerant; a condenser that condenses a high-pressure gas refrigerant through heat exchange with a first non-refrigerant supplied by a first-non-refrigerant pump; an expansion valve that expands a liquid refrigerant derived from the condenser; an evaporator in which the expanded liquid refrigerant evaporates through heat exchange with a second non-refrigerant supplied by a second-non-refrigerant pump; a bypass-circuit control valve that is provided in a bypass circuit used to inject part of the high-pressure gas refrigerant compressed by the centrifugal compressor into a suction port of the centrifugal compressor and that controls the flow rate of the high-pressure gas refrigerant; a compressor-suction-port pressure measurement unit for measuring a suction pressure of the gas refrigerant at the centrifugal compressor; and a second-non-refrigerant outlet temperature measurement unit for measuring an outlet temperature of the second non-refrigerant at the evaporator; the control method including the steps of: when the turbo refrigeration unit is started-up, controlling the expansion valve so as to be closed; operating the first-non-refrigerant pump and the second-non-refrigerant pump; starting-up the centrifugal compressor; and controlling the degree-of-opening of the bypass-circuit control valve such that the temperature difference between a suction saturation temperature at the centrifugal compressor and the outlet temperature of the second non-refrigerant becomes equal to or less than a predetermined temperature difference.

When the turbo refrigeration unit is started-up, the turbo refrigeration unit is controlled such that the temperature difference between the suction saturation temperature at the centrifugal compressor and the outlet temperature of the second non-refrigerant becomes equal to or less than the predetermined temperature difference. Thus, the amount of liquid refrigerant remaining in the evaporator can be reduced. Therefore, even when the amount of refrigerant filled in the turbo refrigeration unit is reduced, stable operation of the refrigerant turbo refrigeration unit can be achieved.

Advantageous Effects of Invention

According to the turbo-refrigeration-unit control device of the present invention, attention is focused on the fact that, when the liquid refrigerant remains in the evaporator, the liquid refrigerant evaporates, increasing the gas-phase-refrigerant occupancy in the evaporator, and contact between the second non-refrigerant and the liquid refrigerant is reduced, thus reducing the heat to be transferred from the second non-refrigerant to the refrigerant and increasing the temperature difference between the suction saturation temperature at the centrifugal compressor and the outlet of the second non-refrigerant. Specifically, when the turbo refrigeration unit is started-up, the control device closes the expansion valve and controls the degree-of-opening of the bypass-circuit control valve, which guides part of the compressed high-pressure gas refrigerant derived from the centrifugal compressor to the suction port of the centrifugal compressor, such that the temperature difference between the suction saturation temperature at the centrifugal compressor and the outlet temperature of the second non-refrigerant becomes equal to or less than the predetermined temperature difference. Thus, the amount of liquid refrigerant remaining in the evaporator can be reduced. Therefore, when the turbo refrigeration unit is started-up, stable operation can be achieved.

BRIEF DESCRIPTION OF DRAWINGS

FIG. 9 is a P-h diagram showing a refrigeration cycle and a formula for calculating the amount of heat Hc shown in FIG. 7.

DESCRIPTION OF EMBODIMENTS

First Embodiment

A first embodiment of the present invention will be described below with reference to FIGS. 1 to 4.

Figure 1:
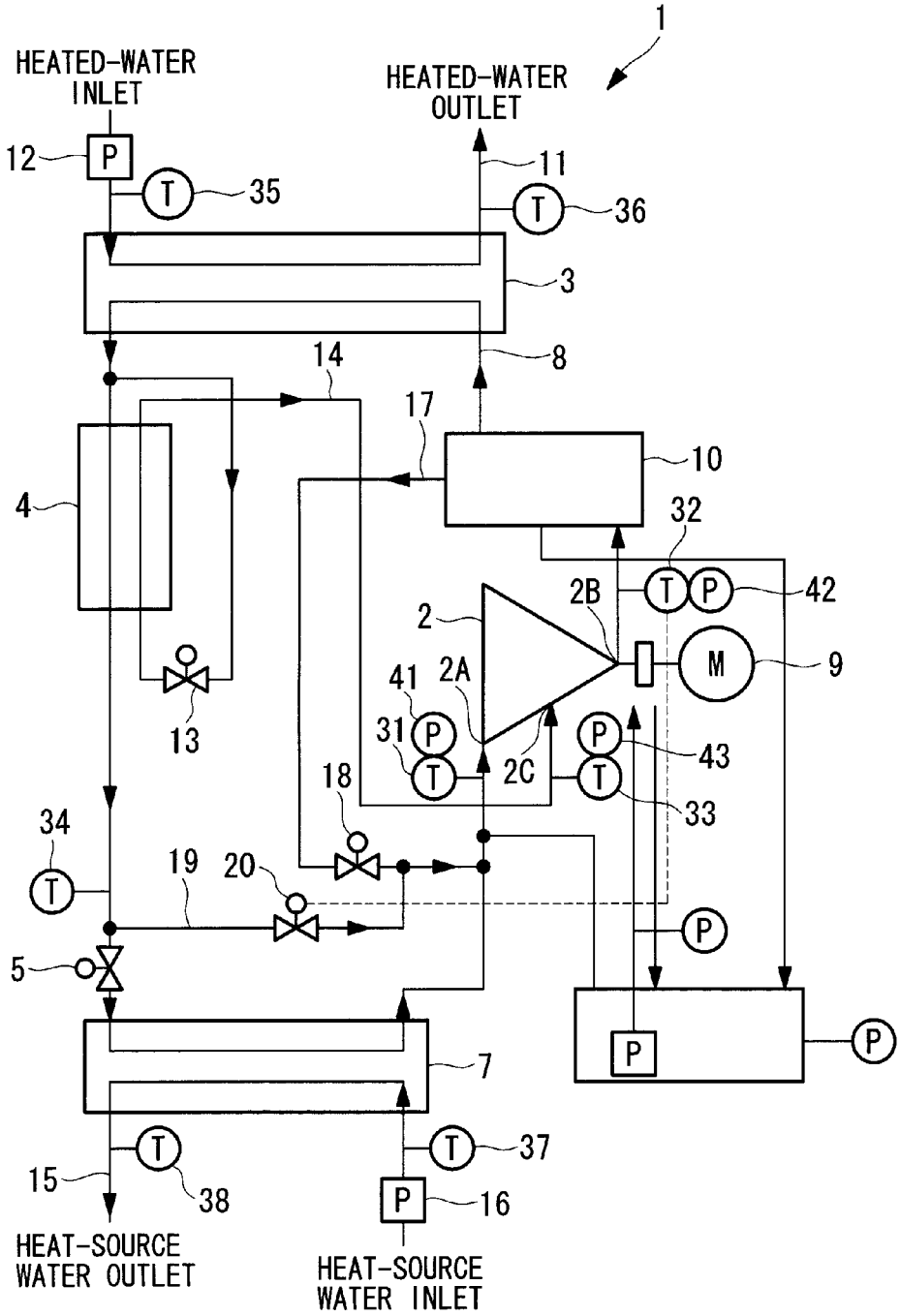
FIG. 1 is a diagram showing a refrigeration cycle of a turbo refrigeration unit according to a first embodiment of the present invention.
Figure 2:
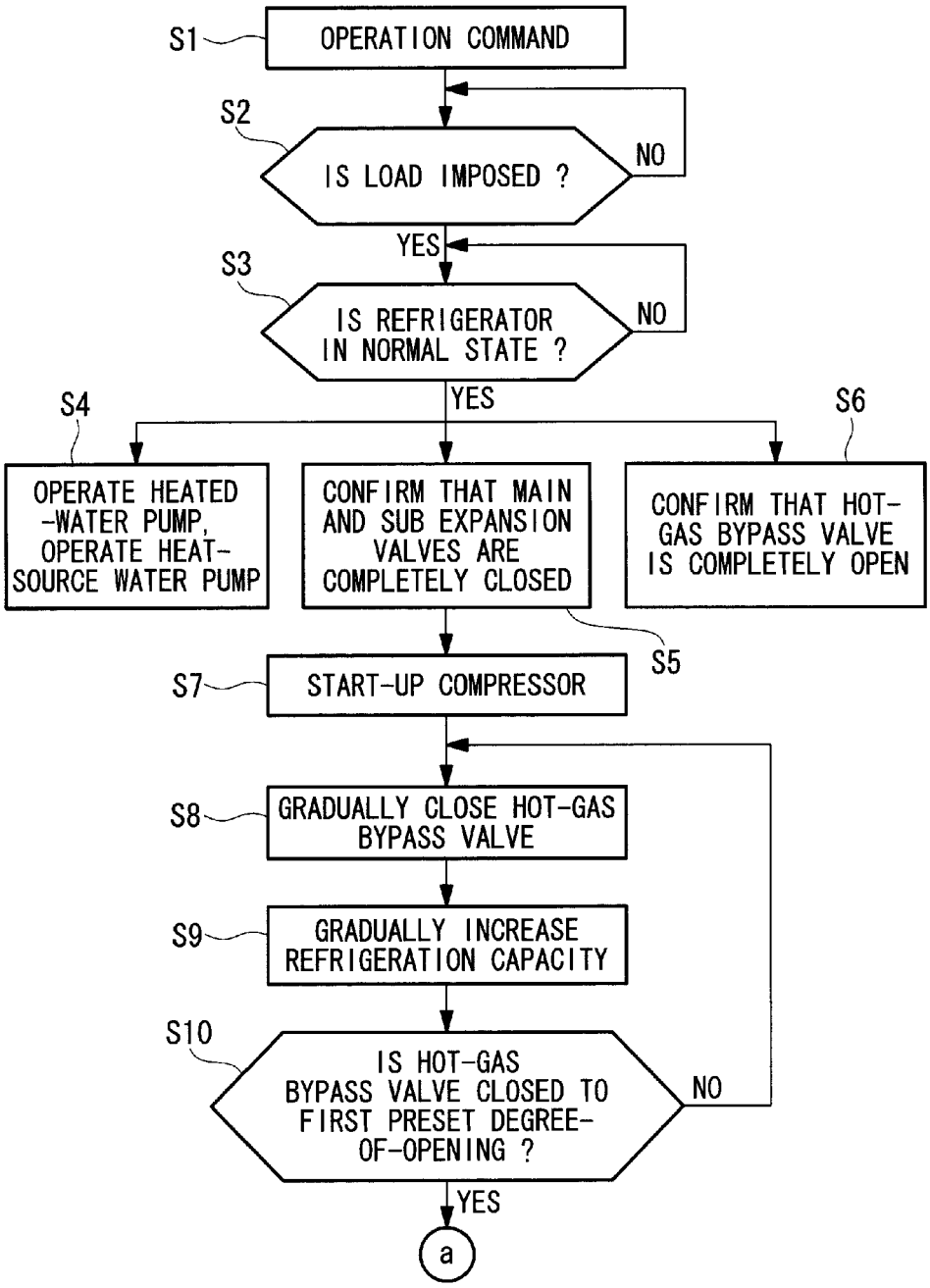
FIG. 2 is a first half of a flowchart at the time of starting-up the turbo refrigeration unit shown in FIG. 1.
Figure 3:
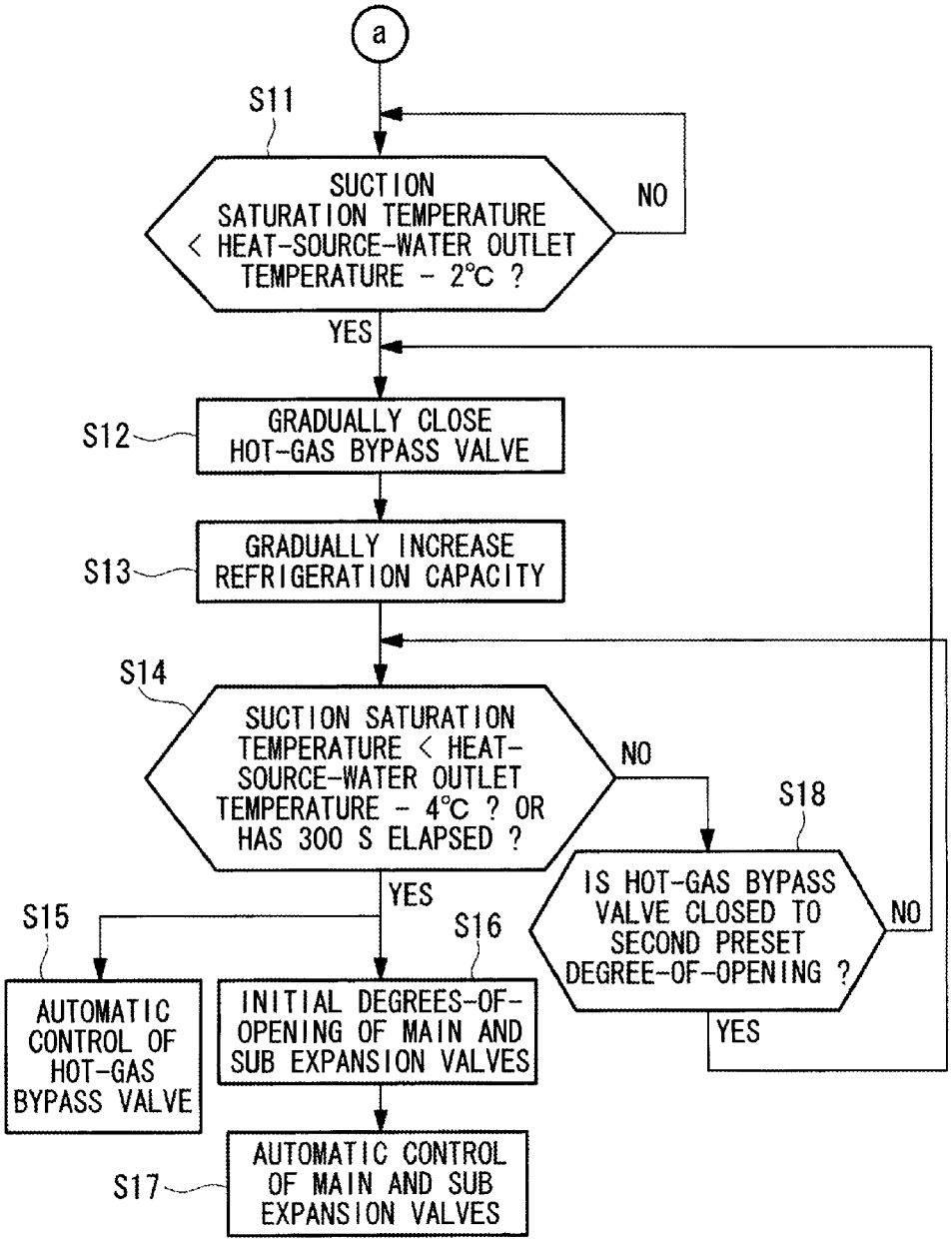
FIG. 3 is a last half of the flowchart at the time of starting-up the turbo refrigeration unit shown in FIG. 1.

FIG. 1 is a diagram showing a refrigeration cycle of a turbo refrigeration unit according to the first embodiment of the present invention. FIGS. 2 and 3 show a flowchart at the time of starting-up the turbo refrigeration unit shown in FIG. 1.

A turbo refrigeration unit 1 includes a control device (not shown) and a closed circuit that sequentially connects a two-stage turbo compressor (centrifugal compressor) 2, a condenser 3, an economizer 4, a main expansion valve (second expansion valve) 5, and an evaporator 7.

The two-stage turbo compressor 2 is a multistage centrifugal compressor driven by an inverter motor 9, includes, in addition to a suction port 2A and a discharge port 2B, an intermediate suction port 2C provided between a first impeller and a second impeller (not shown), and has a configuration in which a low-pressure gas refrigerant suctioned from the suction port 2A is centrifugally-compressed sequentially with the rotation of the first impeller and the second impeller, and the compressed high-pressure gas refrigerant is discharged from the discharge port 2B.

The high-pressure gas refrigerant discharged from the discharge port 2B of the two-stage turbo compressor 2 is guided to an oil-mist separation tank 10 and is centrifugally-separated in the oil-mist separation tank 10. The high-pressure cooled gas from which oil has been centrifugally-separated is guided from the oil-mist separation tank 10 to the condenser 3.

The condenser 3 is a plate-type heat exchanger and condenses the high-pressure cooled gas to liquid through heat exchange between the high-pressure gas refrigerant that has been supplied from the two-stage turbo compressor 2 via the oil-mist separation tank 10 and heated water (first non-refrigerant) circulating via a heated-water circuit 11. Note that it is preferable that the heated water, which is supplied by a heated-water pump (first-non-refrigerant pump) 12, and the high-pressure gas refrigerant flow in opposite directions.

The economizer 4 is a plate-type refrigerant/refrigerant heat exchanger that performs heat exchange between a liquid refrigerant flowing in a main circuit of a refrigeration cycle 8 and a refrigerant that flows separately from the main circuit and that has been reduced in pressure by a sub expansion valve (first expansion valve) 13, thereby supercooling the liquid refrigerant flowing in the main circuit with latent heat of evaporation of the refrigerant. Furthermore, the economizer 4 is provided with a gas circuit 14 that is used to inject a gas refrigerant (intermediate-pressure refrigerant) evaporated by supercooling the liquid refrigerant, into an intermediate-pressure compressed refrigerant from the intermediate suction port 2C of the two-stage turbo compressor 2, thereby configuring an intercooler-type economizer cycle.

The refrigerant supercooled via the economizer 4 is expanded by passing through the main expansion valve 5 and is supplied to the evaporator 7. The evaporator 7 is a plate-type heat exchanger and performs heat exchange between the refrigerant guided from the main expansion valve 5 and heat-source water (second non-refrigerant) circulating via a heat-source water circuit 15, thereby evaporating the refrigerant and cooling the heat-source water with the latent heat of evaporation of the refrigerant. Note that it is preferable that the heat-source water, which is supplied by a heat-source water pump (second-non-refrigerant pump) 16, and the refrigerant flow in opposite directions.

Furthermore, the refrigeration cycle 8 is provided with a bypass circuit 17 that is used to bypass part of the high-pressure gas refrigerant from which oil has been separated in the oil-mist separation tank 10, from a portion between the condenser 3 and the two-stage turbo compressor 2. The bypass circuit 17 is provided with a hot-gas bypass valve (bypass-circuit control valve) 18 that adjusts the flow rate of the high-pressure gas refrigerant to be guided from the bypass circuit 17 to the two-stage turbo compressor 2.

Furthermore, a liquid-refrigerant injection circuit 19 that guides part of the supercooled refrigerant from a portion between the economizer 4 and the main expansion valve 5 joins the bypass circuit 17 at the downstream side of the hot-gas bypass valve 18. In this way, the low-temperature refrigerant from the liquid-refrigerant injection circuit 19 is merged with the bypass circuit 17, thereby making it possible to cool the high-pressure gas refrigerant guided to the downstream side of the bypass circuit 17 where the liquid-refrigerant injection circuit 19 joins.

The liquid-refrigerant injection circuit 19, which joins the bypass circuit 17, is provided with a liquid injection valve (liquid-refrigerant injection control valve) 20 that adjusts the flow rate of the supercooled refrigerant guided through the liquid-refrigerant injection circuit 19.

Furthermore, as measurement means for measuring the temperatures and the pressures of the refrigerant, the heated water, and the heat-source water, manometers (pressure measurement unit) 41, 42, and 43 and thermometers (temperature measurement unit) 31, 32, and 33 are provided at the suction port 2A, the discharge port 2B, and the intermediate suction port 2C of the two-stage turbo compressor 2; thermometers 35, 36, 37, and 38 are provided at an inlet and an outlet of the heated-water circuit 11 and at an inlet and an outlet of the heat-source water circuit 15; and a thermometer 34 is provided at an inlet of the main expansion valve 5.

Next, a flowchart at the time of starting-up the turbo refrigeration unit 1 will be described with reference to FIGS. 2 and 3.

As shown in FIG. 2, when an operation command for starting-up the turbo refrigeration unit 1 is given in Step 1, it is determined whether a temperature difference exists between a heated-water inlet temperature and a heated-water outlet temperature that are measured by the thermometers 35 and 36 provided at the inlet and the outlet of the heated-water circuit 11 in the condenser 3 and whether the heated-water outlet temperature is equal to or higher than a predetermined temperature (Step 2). If a temperature difference exists between the heated-water inlet temperature and the heated-water outlet temperature and if the heated-water outlet temperature is equal to or lower than the predetermined temperature, it is judged that a load is imposed, and the processing flow advances to Step 3. If it is judged that a load is not imposed, i.e., if the heated-water outlet temperature is equal to or higher than the predetermined temperature, Step 2 is repeated.

If it is judged in Step 2 that a load is imposed, it is determined whether the manometers 41, 42, and 43 and the thermometers 31, 32, 33, 34, 35, 36, 37, and 38, which are provided in the turbo refrigeration unit 1, are operating normally, whether numerical values sent from the manometers 41, 42, and 43 and the thermometers 31, 32, 33, 34, 35, 36, 37, and 38 are normal values, and whether the numerical values sent from the manometers 41, 42, and 43 and the thermometers 31, 32, 33, 34, 35, 36, 37, and 38 fall within expected ranges (Step 3). In Step 3, if the manometers 41, 42, and 43 and the thermometers 31, 32, 33, 34, 35, 36, 37, and 38 are not operating normally, if those numerical values are abnormal, or if those numerical values do not fall within the expected ranges, it is judged that the turbo refrigeration unit 1 is in an abnormal state, and Step 3 is repeated.

If it is determined in Step 3 that the manometers 41, 42, and 43 and the thermometers 31, 32, 33, 34, 35, 36, 37, and 38, which are provided in the turbo refrigeration unit 1, are normal, it is judged that the turbo refrigeration unit 1 is in a normal state, and the operations of the heated-water pump 12 and the heat-source water pump 16 are started (Step 4). Furthermore, it is confirmed that the main expansion valve 5 and the sub expansion valve 13 are completely closed (Step 5). Furthermore, it is confirmed that the hot-gas bypass valve 18 is completely open (Step 6).

After Steps 4 to 6 are confirmed, the two-stage turbo compressor 2 is started-up (Step 7).

Then, the hot-gas bypass valve 18 is gradually closed (Step 8). Furthermore, the degree-of-opening of the liquid injection valve 20 is controlled based on a compressor discharge-port temperature that is measured by the thermometer 32, provided at the discharge port 2B of the centrifugal compressor 2. In this way, the supercooled refrigerant is merged with the bypass circuit 17 from the liquid-refrigerant injection circuit 19, and the reduced-temperature gas refrigerant is guided to the suction port 2A of the centrifugal compressor 2, thereby making it possible to reduce the compressor discharge-port temperature and to gradually increase the refrigeration capacity of the turbo refrigeration unit 1 (Step 9).

When the refrigeration capacity is gradually increased, Steps 8 and 9 are repeated until the hot-gas bypass valve 18 is closed to a first preset degree-of-opening (Step 10).

The inventors found that, in a case where a large amount of liquid refrigerant remains in the evaporator 7, when the temperature difference between a suction saturation temperature at the two-stage turbo compressor 2 and the heat-source-water outlet temperature becomes 2° C., the liquid refrigerant remaining in the evaporator 7 starts to evaporate.

Thus, after the hot-gas bypass valve 18 is closed to the first preset degree-of-opening, as shown in FIG. 3, it is determined whether the suction saturation temperature at the suction port 2A of the two-stage turbo compressor 2 is lower than the temperature obtained by subtracting 2° C. (predetermined temperature difference) from the heat-source-water outlet temperature, measured by the thermometer 38 provided at the outlet of the heat-source water circuit 15 in the evaporator 7 (Step 11).

In this way, when the suction saturation temperature at the two-stage turbo compressor 2 becomes lower than the temperature obtained by subtracting 2° C. from the heat-medium-water outlet temperature at the heat-medium water circuit 15, the liquid refrigerant remaining in the evaporator 7 starts to evaporate. On the other hand, the suction saturation temperature at the two-stage turbo compressor 2 is equal to or higher than the temperature obtained by subtracting 2° C. from the heat-source-water outlet temperature, Step 11 is repeated.

Note that the suction saturation temperature at the two-stage turbo compressor 2 is calculated from a suction pressure measured by the manometer 41, provided at the suction port 2A of the two-stage turbo compressor 2.

If it is determined in Step 11 that the suction saturation temperature is lower than the temperature obtained by subtracting 2° C. from the heat-source-water outlet temperature, the hot-gas bypass valve 18 is further gradually closed (Step 12), and the refrigeration capacity is further gradually increased (Step 13).

The inventors found that, in a case where a large amount of liquid refrigerant remains in the evaporator 7, no large difference exists between the suction saturation temperature at the two-stage turbo compressor 2 and the heat-source-water outlet temperature; however, when the suction saturation temperature at the two-stage turbo compressor 2 is lower than the temperature obtained by subtracting 4° C. (predetermined temperature difference) from the heat-source-water outlet temperature, most of the liquid refrigerant remaining in the evaporator 7 evaporates.

Thus, after Step 13, it is determined whether the suction saturation temperature at the two-stage turbo compressor 2 is lower than the temperature obtained by subtracting 4° C. from the heat-source-water outlet temperature or whether 300 seconds have elapsed since the turbo refrigeration unit 1 was started-up (Step 14).

In Step 14, if the suction saturation temperature at the two-stage turbo compressor 2 is lower than the temperature obtained by subtracting 4° C. from the heat-source-water outlet temperature, or if 300 seconds have elapsed since the turbo refrigeration unit 1 was started-up, most of the liquid refrigerant remaining in the evaporator 7 evaporates, so that there is no possibility that the liquid refrigerant is suctioned into the two-stage turbo compressor 2 even when the main expansion valve 5 and the sub expansion valve 13 are open.

Thus, the hot-gas bypass valve 18 is automatically controlled (Step 15), and the initial degrees-of-opening of the main expansion valve 5 and the sub expansion valve 13 are set (Step 16). Automatic control of the main expansion valve 5 and automatic control of the sub expansion valve 13 for which the initial degrees-of-opening have been set are started (Step 17).

On the other hand, if it is determined in Step 14 that the suction saturation temperature at the two-stage turbo compressor 2 is equal to or higher than the temperature obtained by subtracting 4° C. from the heat-source-water outlet temperature or that the elapsed time since the turbo refrigeration unit 1 was started-up is less than 300 seconds, it is judged that the liquid refrigerant remaining in the evaporator 7 has not evaporated enough, and the processing flow advances to Step 18. In Step 18, the hot-gas bypass valve 18 is further closed until the degree-of-opening thereof becomes a second preset degree-of-opening.

If the degree-of-opening of the hot-gas bypass valve 18 has become the second preset degree-of-opening, the processing flow advances to Step 14. If the degree-of-opening of the hot-gas bypass valve 18 has not become the second preset degree-of-opening, Steps 12 to 14 are repeated.

As described above, the main expansion valve 5 and the sub expansion valve 13 are opened after the liquid refrigerant remaining in the evaporator 7 is made to evaporate, thereby avoiding a situation in which the two-stage turbo compressor 2 suctions the liquid refrigerant when the turbo refrigeration unit 1 is started-up. Thus, it is possible to reduce the incidence of a failure of the two-stage turbo cooler 2 and to stably control the turbo refrigeration unit 1.

Note that, in this embodiment, a description has been given of a case where an elapsed time of 300 seconds after the turbo refrigeration unit 1 is started-up is used in Step 14; however, the elapsed time may be changed depending on the inner volume of the evaporator 7 provided in the turbo refrigeration unit 1.

Next, a P-h diagram of this embodiment will be described with reference to FIG. 4.

Figure 4:
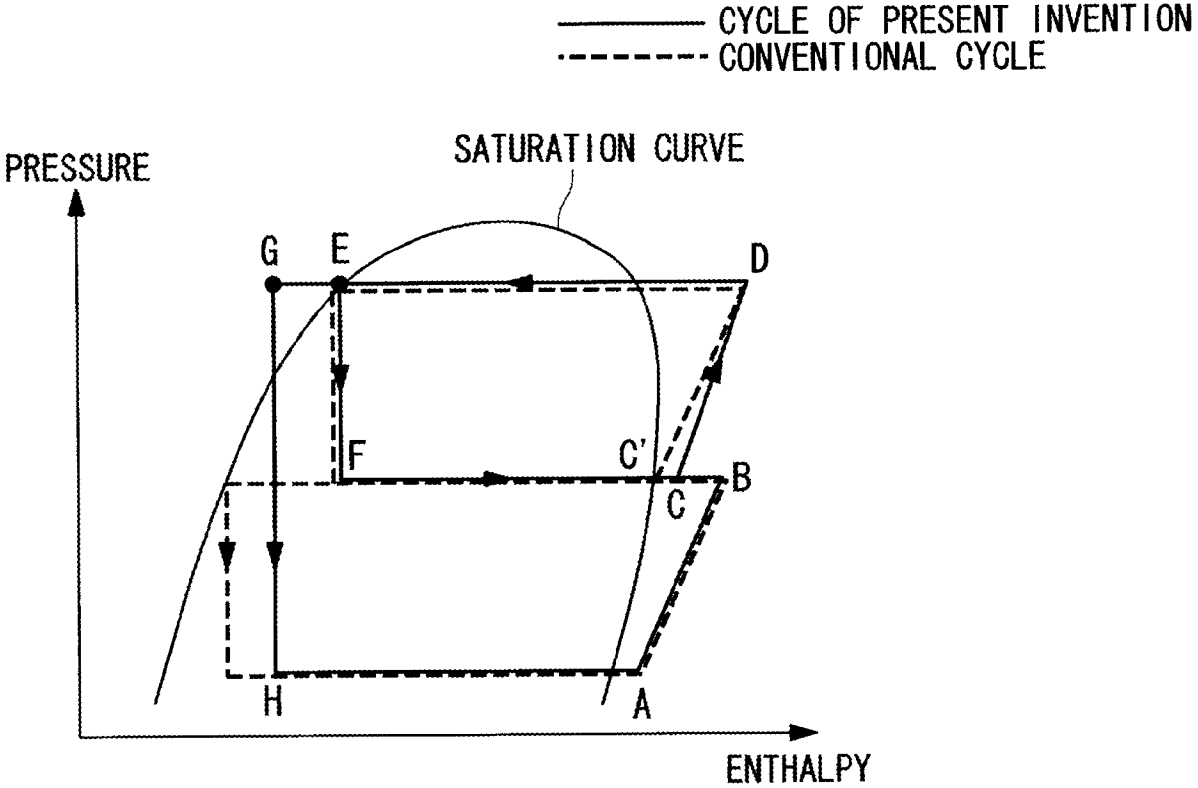
FIG. 4 is a P-h diagram showing a cycle of the turbo refrigeration unit of the present invention and a conventional cycle.

In FIG. 4, the dashed line indicates a conventional case, and the solid line indicates a case of this embodiment.

In the refrigeration cycle 8 of the turbo refrigeration unit 1 of this embodiment, the low-temperature low-pressure gas refrigerant (Point A) that is suctioned into the suction port 2A of the two-stage turbo compressor 2 is compressed up to Point B by the first impeller, is mixed with the intermediate-pressure gas refrigerant that is injected from the intermediate suction port 2C to be in a state of Point C, and is suctioned by the second impeller to be compressed up to Point D.

The high-pressure gas refrigerant that is discharged from the two-stage turbo compressor 2 in this state is condensed to liquid by being cooled in the condenser 3 to become a high-pressure liquid refrigerant at Point E. Part of the liquid refrigerant at Point E flows separately, is reduced in pressure down to Point F by the sub expansion valve 13, and flows into the economizer 4.

This intermediate-pressure refrigerant is subjected to heat exchange, in the economizer 4, with the liquid refrigerant at Point E flowing in the main circuit of the turbo refrigeration unit 1, absorbs heat from the liquid refrigerant (E), causing it to evaporate, and is injected from the intermediate suction port 2C of the two-stage turbo compressor 2 via the gas circuit 14 into the intermediate-pressure gas refrigerant that is being compressed.

On the other hand, in the economizer 4, the liquid refrigerant (E) in the main circuit that has been subjected to heat exchange with the refrigerant at Point F is supercooled down to Point G and reaches the outlet of the economizer 4. The liquid refrigerant flowing out from the economizer 4 is reduced in pressure down to Point H by the main expansion valve 5 and flows into the evaporator 7.

Part of the liquid refrigerant (E) flowing out from the economizer 4 separately flows into the liquid-refrigerant injection circuit 19 and returns to a portion between the evaporator 7 and the two-stage turbo compressor 2 via the bypass circuit 17, thus joining the outlet refrigerant (A) of the evaporator 7.

The liquid-single-phase refrigerant supplied to the evaporator 7 is subjected to heat exchange with the heat-source water circulating via the heat-source water circuit 15 to evaporate. Thus, the heat-source water circulating via the heat-source water circuit 15 is cooled. The refrigerant subjected to heat exchange via the heat-source water circuit 15 becomes the low-pressure gas refrigerant (A), merges with the reduced-temperature gas refrigerant that has been guided from the bypass circuit 17, and is then suctioned into the two-stage turbo compressor 2 again. Thereafter, the above-described operation is repeated.

As described above, according to the turbo refrigeration unit 1, the control device therefor, and the control method therefor of this embodiment, the following advantages are afforded.

When the turbo refrigeration unit 1 is started-up, the control device (not shown) closes the main expansion valve (expansion valve) 5 and the sub expansion valve (expansion valve) 13 and controls the degree-of-opening of the hot-gas bypass valve (bypass-circuit control valve) 18, which guides part of the compressed high-pressure gas refrigerant derived from the two-stage turbo compressor 2 to the suction port 2A of the two-stage turbo compressor 2, such that the temperature difference between the suction saturation temperature at the two-stage turbo compressor (centrifugal compressor) 2 and the outlet temperature of the heat-source water (second non-refrigerant) is equal to or less than −2° C. (predetermined temperature difference) and −4° C. (predetermined temperature difference). Thus, the amount of liquid refrigerant remaining in the evaporator 7 can be reduced. Therefore, when the turbo refrigeration unit 1 is started-up, stable operation can be achieved.

The control device, which controls the degree-of-opening of the liquid injection valve (liquid-refrigerant injection control valve) 20 based on the discharge-port temperature at the two-stage turbo compressor 2, is used. Thus, it is possible to control the temperature of the gas refrigerant to be guided to the suction port 2A of the two-stage turbo compressor 2, by injecting the low-temperature liquid refrigerant into the high-temperature high-pressure gas refrigerant guided from the bypass circuit 17. Therefore, the temperature of the refrigerant to be guided to the suction port 2A of the two-stage turbo compressor 2 can be reduced.

By using the control device, which controls the heated-water pump (first-non-refrigerant pump) 12, the heat-source water pump (second-non-refrigerant pump) 16, the hot-gas bypass valve (bypass-circuit control valve) 18, the two-stage turbo compressor 2, the main expansion valve 5, and the sub expansion valve 13, it is possible to make the temperature difference between the suction saturation temperature at the two-stage turbo compressor 2 and the outlet temperature of the heat-source water equal to or less than −2° C. and −4° C. Thus, it is possible to reduce the amount of liquid refrigerant remaining in the evaporator 7 and to achieve stable operation when the turbo refrigeration unit 1 is started-up. Thus, the inner volumes of the condenser 3, the economizer 4, and the evaporator 7 can be reduced. Therefore, it is possible to reduce the inner volume of the whole turbo refrigeration unit 1, thus reducing the amount of circulating refrigerant by 30 to 40 percent compared with conventional technologies, for example, and to achieve stable operation of the turbo refrigeration unit 1.

Furthermore, because it is possible to avoid a situation in which the liquid refrigerant remaining in the condenser 7 is guided to the suction port 2A of the two-stage turbo compressor 2, a gas-liquid separator (not shown) that has been conventionally required can be eliminated.

When the turbo refrigeration unit 1 is started-up, the turbo refrigeration unit 1 is controlled such that the temperature difference between the suction saturation temperature at the two-stage turbo compressor 2 and the outlet temperature of the heat-source water is equal to or less than −2° C. and −4° C. Thus, the amount of liquid refrigerant remaining in the evaporator 7 can be reduced. Therefore, the refrigerant turbo refrigeration unit 1 can be stably operated even when the amount of refrigerant filled in the turbo refrigeration unit 1 is reduced.

Second Embodiment

A turbo refrigeration unit, a control device therefor, and a control method therefor of this embodiment differ from those of the first embodiment in that, when the turbo refrigeration unit is started-up, the heat-source water is output after the temperature of the heat-source water is reduced to a predetermined temperature, and are the same as those of the first embodiment in the other points. Therefore, identical reference symbols are assigned to the same components and flows as those of the first embodiment, and a description thereof will be omitted.

A second embodiment of the present invention will be described below with reference to FIGS. 5 and 6.

Figure 5:
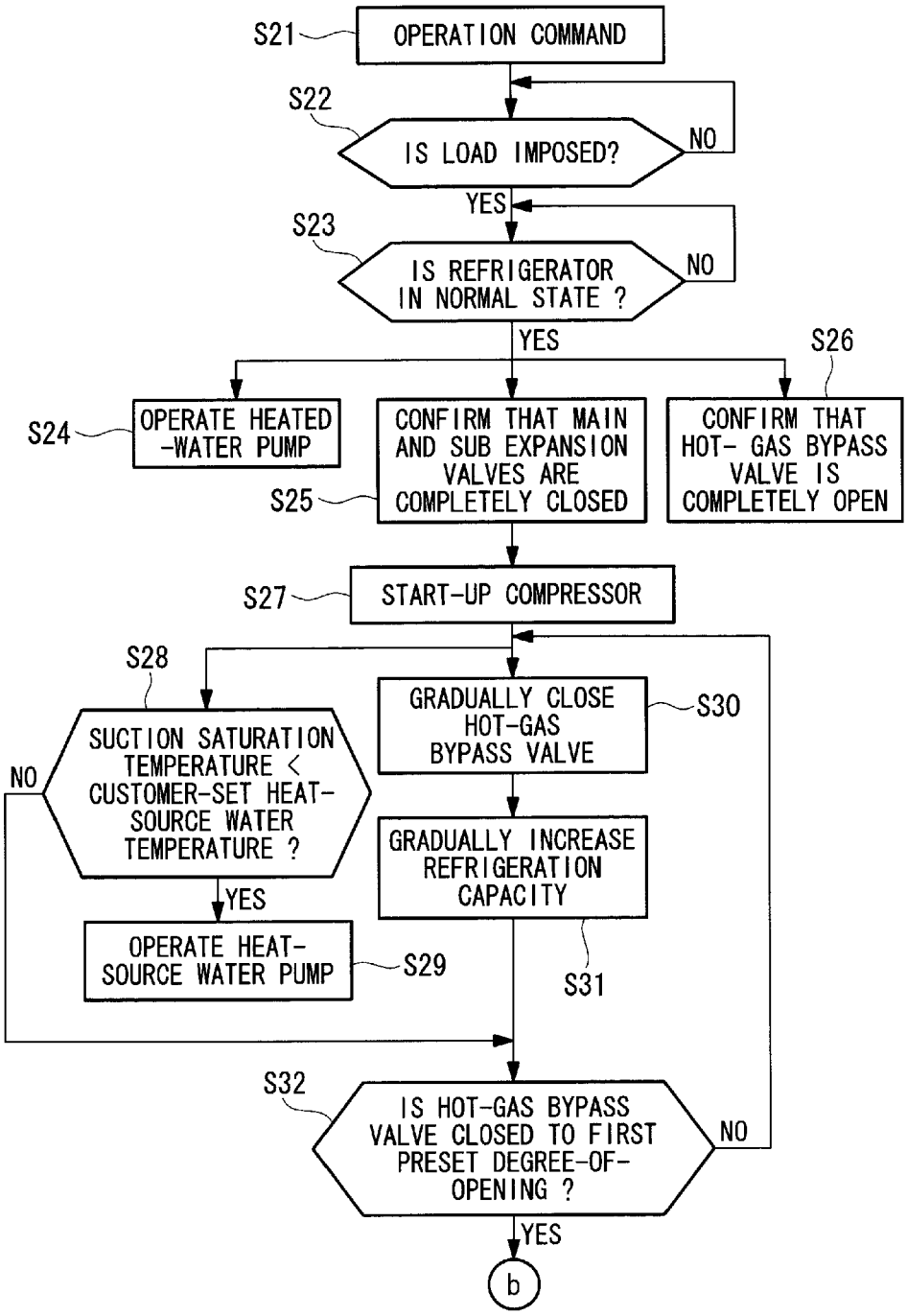
FIG. 5 is a first half of a flowchart at the time of starting-up a turbo refrigeration unit according to a second embodiment of the present invention.

As shown in FIG. 5, an operation command for starting-up the turbo refrigeration unit is given (Step 21).

After the operation command is given in Step 21, it is determined whether a temperature difference exists between the heated-water inlet temperature of the heated water (first non-refrigerant) and the heated-water outlet temperature thereof, which are measured by the thermometers provided at the inlet and the outlet of the heated-water circuit in the condenser, and whether the heated-water outlet temperature is equal to or higher than a predetermined temperature (Step 22). If a temperature difference exists between the heated-water inlet temperature and the heated-water outlet temperature and if the heated-water outlet temperature is equal to or lower than the predetermined temperature, it is judged that a load is imposed, and the processing flow advances to Step 23. If it is judged that a load is not imposed, i.e., if the heated-water outlet temperature is equal to or higher than the predetermined temperature, Step 22 is repeated.

If it is judged in Step 22 that a load is imposed, it is determined whether the manometers (pressure measurement unit) and the thermometers (temperature measurement unit), provided in the turbo refrigeration unit, are operating normally, whether numerical values sent from the manometers and the thermometers are normal values, and whether the numerical values sent from the manometers and the thermometers fall within expected ranges (Step 23). In Step 23, if the manometers and the thermometers are not operating normally, if those numerical values are abnormal, or if those numerical values do not fall within the expected ranges, it is judged that the turbo refrigeration unit is in an abnormal state, and Step 23 is repeated.

If it is determined in Step 23 that the manometers and the thermometers, provided in the turbo refrigeration unit, are normal, it is judged that the turbo refrigeration unit is in a normal state, and the operation of the heated-water pump (first-non-refrigerant pump) is started (Step 24). Furthermore, it is confirmed that the main expansion valve (expansion valve) and the sub expansion valve (expansion valve) are completely closed (Step 25). Furthermore, it is confirmed that the hot-gas bypass valve (bypass-circuit control valve) is completely open (Step 26).

After all the Steps 24 to 26 are confirmed, the two-stage turbo compressor (centrifugal compressor) is started-up (Step 27). Note that the degree-of-opening of the liquid injection valve (liquid-refrigerant injection control valve) is controlled based on the compressor discharge-port temperature measured by the thermometer provided at the discharge port of the two-stage turbo compressor.

Then, it is determined whether the suction saturation temperature at the suction port of the two-stage turbo compressor is lower than a customer-set heat-source water temperature (predetermined temperature) (Step 28). In Step 28, if the suction saturation temperature at the suction port of the two-stage turbo compressor is lower than the customer-set heat-source water temperature, the operation of the heat-source water pump (second-non-refrigerant pump) is started (Step 29). In Step 28, if the suction saturation temperature at the suction port of the two-stage turbo compressor is equal to or higher than the customer-set heat-source water temperature, the processing flow advances to Step 32.

Furthermore, after Step 27, the hot-gas bypass valve is gradually closed (Step 30). In this way, the supercooled refrigerant guided from the liquid-refrigerant injection circuit is made to join the bypass circuit, and the reduced-temperature gas refrigerant is guided to the suction port of the centrifugal compressor; thus, the refrigerant in the turbo refrigeration unit starts to evaporate, which gradually increases the refrigeration capacity (Step 31).

Steps 28, 29, 30, and 31 are repeated until the degree-of-opening of the hot-gas bypass valve becomes the predetermined first preset degree-of-opening (Step 32).

Figure 6:
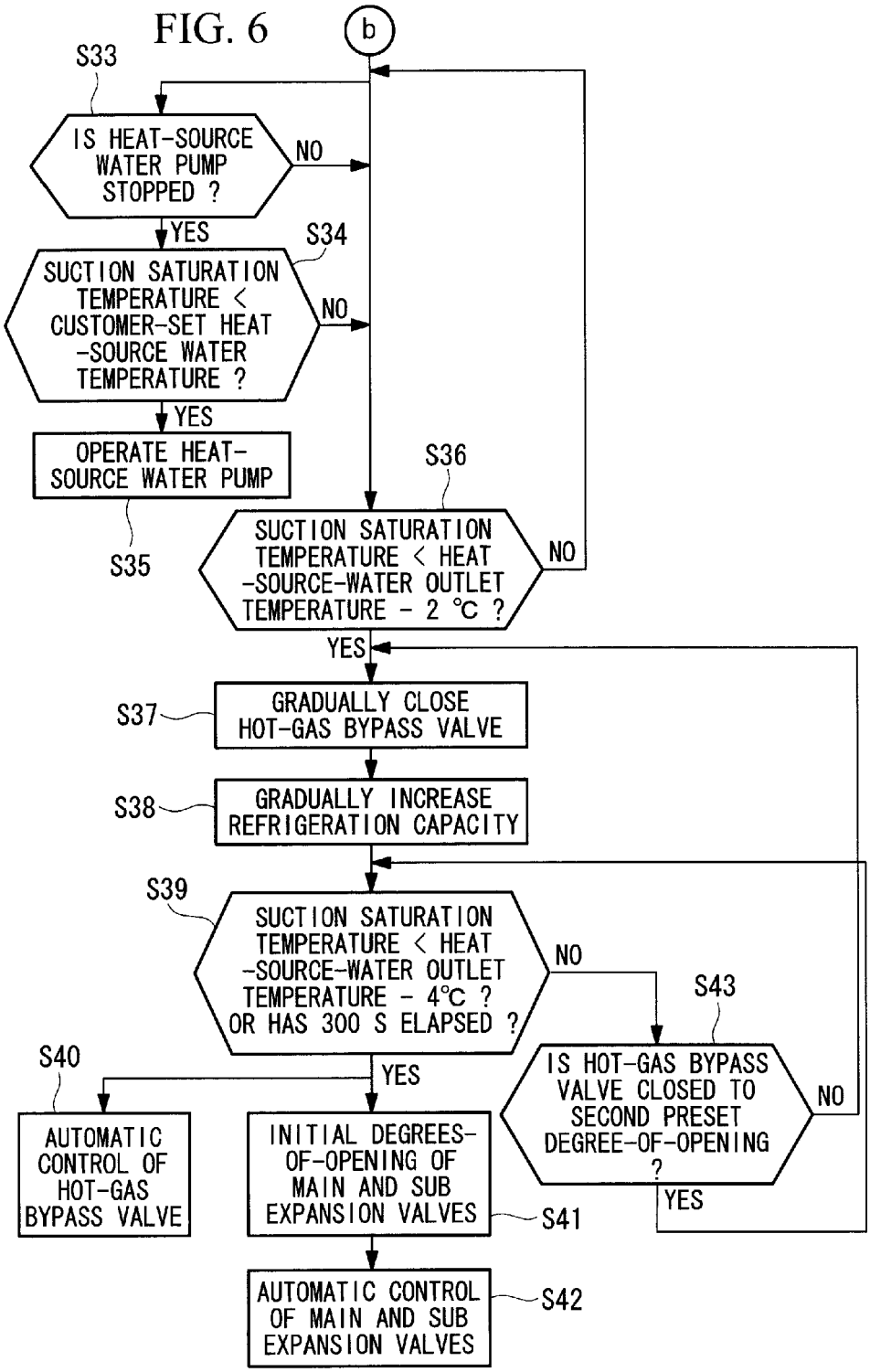
FIG. 6 is a last half of the flowchart at the time of starting-up the turbo refrigeration unit according to the second embodiment of the present invention.

Then, as shown in FIG. 6, after the hot-gas bypass valve is closed to the first preset degree-of-opening, the operating state of the heat-source water pump is determined (Step 33). If the heat-source water pump is being operated, the processing flow advances to Step 36. If the heat-source water pump is stopped, it is determined whether the suction saturation temperature at the suction port of the two-stage turbo compressor is lower than the customer-set heat-source water temperature (Step 34). In Step 34, if the suction-port saturation temperature is equal to or higher than the customer-set heat-source water temperature, the processing flow advances to Step 36. If the suction-port saturation temperature is lower than the customer-set heat-source water temperature, the operation of the heat-source water pump is started (Step 35).

After Steps 33, 34, and 35, it is determined whether the suction saturation temperature at the suction port of the two-stage turbo compressor is lower than the temperature obtained by subtracting 2° C. (predetermined temperature difference) from the heat-source-water outlet temperature (Step 36). In Step 36, the condition that the refrigerant remaining in the evaporator starts to evaporate when the suction saturation temperature at the suction port of the two-stage turbo compressor is lower than the temperature obtained by subtracting 2° C. from the heat-source-water outlet temperature is set.

If the suction saturation temperature at the suction port of the two-stage turbo compressor is equal to or higher than the temperature obtained by subtracting 2° C. from the heat-source-water outlet temperature, Steps 33 to 36 are repeated.

In Step 36, if the suction saturation temperature at the suction port of the two-stage turbo compressor is lower than the temperature obtained by subtracting 2° C. from the heat-source-water outlet temperature, the hot-gas bypass valve is further gradually closed (Step 37), and the refrigeration capacity is further gradually increased (Step 38).

After Step 38, it is determined whether the suction saturation temperature at the suction port of the two-stage turbo compressor is lower than the temperature obtained by subtracting 4° C. (predetermined temperature difference) from the heat-source-water outlet temperature or whether 300 seconds have elapsed since the turbo refrigeration unit was started-up (Step 39).

In Step 39, if the suction saturation temperature at the suction port of the two-stage turbo compressor is lower than the temperature obtained by subtracting 4° C. from the heat-source-water outlet temperature, automatic control of the hot-gas bypass valve is started (Step 40), and the initial degrees-of-opening of the main expansion valve and the sub expansion valve are set (Step 41). Automatic control of the main expansion valve and the sub expansion valve for which the initial degrees-of-opening have been set in Step 41 is started (Step 42).

On the other hand, in Step 39, if it is determined that the suction saturation temperature at the suction port of the two-stage turbo compressor is higher than the temperature obtained by subtracting 4° C. from the heat-source-water outlet temperature or if it is determined that the elapsed time since the turbo refrigeration unit was started-up is equal to or less than 300 seconds, the processing flow advances to Step 43.

In Step 43, the hot-gas bypass valve is closed to the second preset degree-of-opening. If the degree-of-opening of the hot-gas bypass valve has become the second preset degree-of-opening, the processing flow advances to Step 39. If the degree-of-opening of the hot-gas bypass valve has not become the second preset degree-of-opening, Steps 37 to 39 are repeated.

As described above, according to the turbo refrigeration unit, the control device therefor, and the control method therefor of this embodiment, the following advantages are afforded.

The control device, which operates the two-stage turbo compressor (centrifugal compressor) with the main expansion valve (expansion valve) and the sub expansion valve (expansion valve) being closed, controls the degree-of-opening of the hot-gas bypass valve (bypass-circuit control valve), and then starts the operation of the heat-source water pump (second-non-refrigerant pump), is used. Thus, it is possible to reduce the temperature of the heat-source water (second non-refrigerant) output from the evaporator when the turbo refrigeration unit is started-up. Therefore, the heat-source water with a customer-set heat-source water temperature (predetermined temperature) can be output from the evaporator.

Third Embodiment

A turbo refrigeration unit, a control device therefor, and a control method therefor of this embodiment differ from those of the first embodiment in the automatic control of the main expansion valve and the sub expansion valve after the turbo refrigeration unit is started-up and are the same as those of the first embodiment in the other points. Therefore, identical reference symbols are assigned to the same components and flows as those of the first embodiment, and a description thereof will be omitted.

Figure 7:
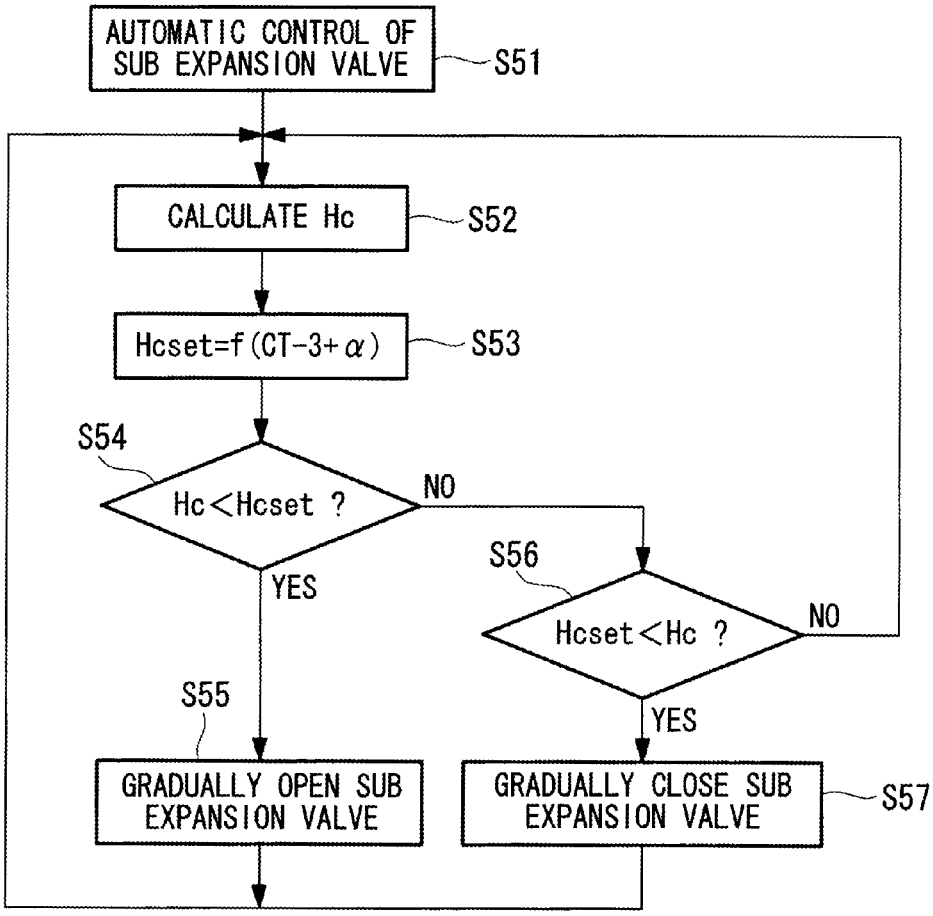
FIG. 7 is a flowchart of automatic control of a sub expansion valve during normal operation of a turbo refrigeration unit according to a third embodiment of the present invention.
Figure 8:
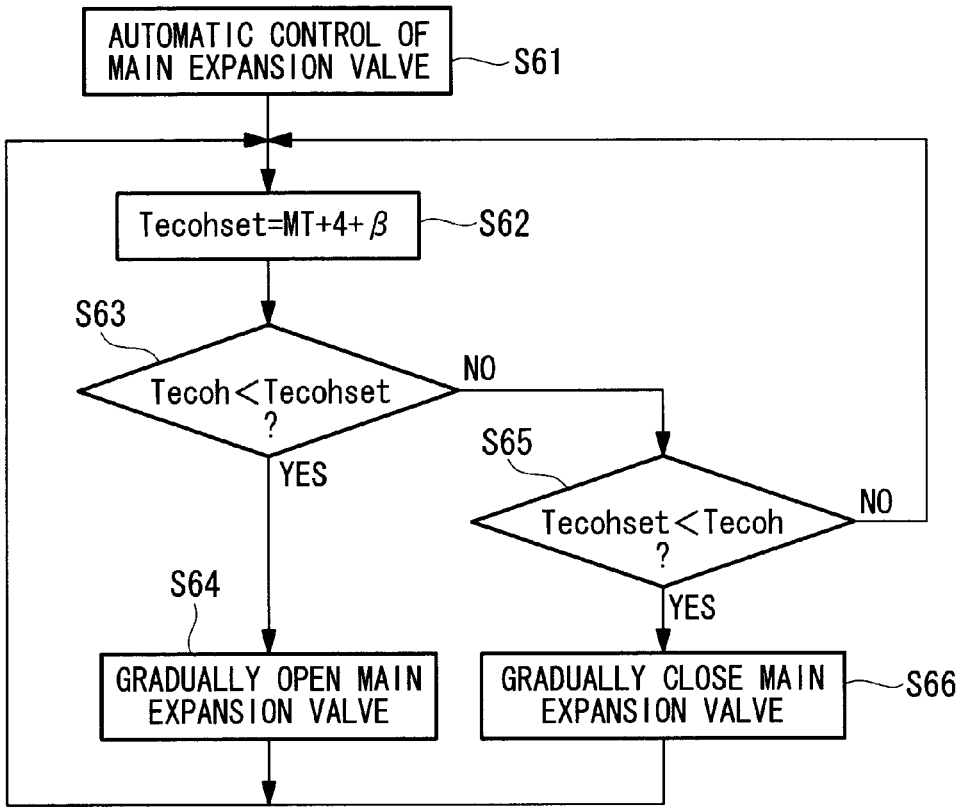
FIG. 8 is a flowchart of automatic control of a main expansion valve during normal operation of the turbo refrigeration unit according to the third embodiment of the present invention.
Figure 10:
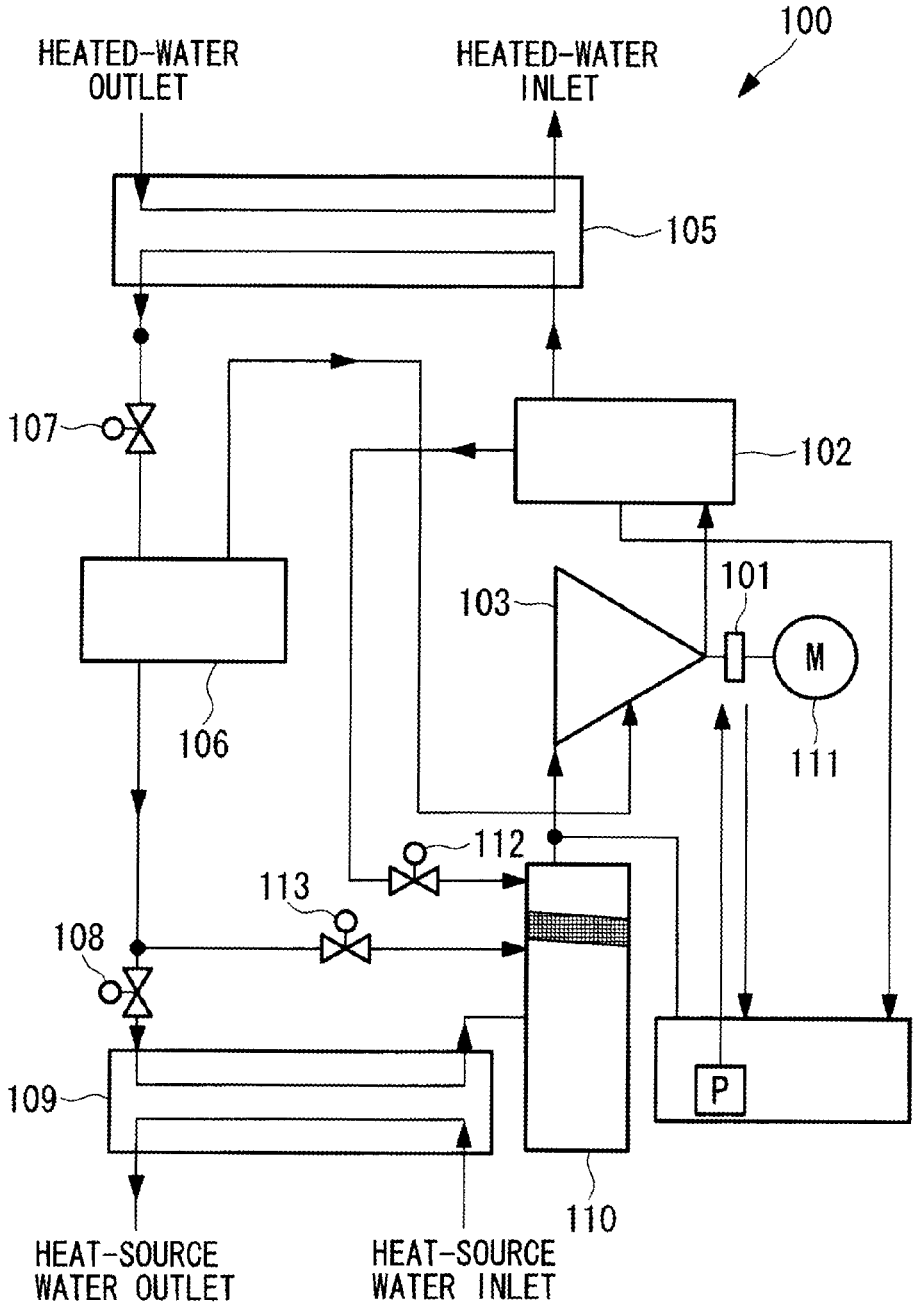
FIG. 10 is a diagram showing a refrigeration cycle of a conventional turbo refrigeration unit.

A third embodiment of the present invention will be described below with reference to FIGS. 7 to 9.

After the turbo refrigeration unit is started-up, it is necessary to prevent the refrigerant from flowing unevenly in the turbo refrigeration unit and to achieve stable operation. Therefore, in this embodiment, the main expansion valve (expansion valve) and the sub expansion valve (expansion valve) are controlled based on the enthalpy state at a condenser outlet.

The flow of automatic control of the sub expansion valve will be described by using a flowchart of FIG. 7, and the flow of automatic control of the main expansion valve will be described by using a flowchart of FIG. 8.

First, automatic control of the sub expansion valve will be described with reference to FIG. 7.

When automatic control of the sub expansion valve is started in Step 51, an enthalpy Hc at the condenser outlet is calculated (Step 52). Note that the enthalpy Hc at the condenser outlet is calculated by using a formula shown in FIG. 9.

After the enthalpy Hc at the condenser outlet is calculated, a set condenser-outlet cooled-liquid enthalpy Hcset is calculated (Step 53). Here, the set condenser-outlet cooled-liquid enthalpy Hcset can be obtained by applying a liquid temperature of the refrigerant that is calculated from a correction value α and a compressor-discharge-pressure saturation temperature CT that is obtained from the discharge pressure at the two-stage turbo compressor (centrifugal compressor), to a function used for calculating liquid enthalpy.

The correction value α used in Step 53 is a value that can be obtained from a condenser exchanged-heat amount Qcon and from the difference between the compressor-discharge-pressure saturation temperature CT that is obtained from the discharge pressure at the two-stage turbo compressor and a compressor-suction-pressure saturation temperature (suction saturation temperature at the suction port of the two-stage turbo compressor) ET that is obtained from the suction pressure at the two-stage turbo compressor.

Then, the enthalpy Hc at the condenser outlet and the set condenser-outlet supercooled-liquid enthalpy Hcset are compared (Step 54). In Step 54, if the enthalpy Hc at the condenser outlet is smaller than the set condenser-outlet supercooled-liquid enthalpy Hcset, the sub expansion valve is gradually opened (Step 55).

On the other hand, in Step 54, if the enthalpy He at the condenser outlet is equal to or larger than the set condenser-outlet supercooled-liquid enthalpy Hcset, the processing flow advances to Step 56, and the enthalpy He at the condenser outlet and the set condenser-outlet supercooled-liquid enthalpy Hcset are compared again.

If the set condenser-outlet supercooled-liquid enthalpy Hcset is smaller than the enthalpy Hc at the condenser outlet in Step 56, the sub expansion valve is gradually closed (Step 57).

When the sub expansion valve is gradually opened in Step 55, when the sub expansion valve is gradually closed in Step 57, or if the set condenser-outlet supercooled-liquid enthalpy Hcset is larger than the enthalpy Hc at the condenser outlet in Step 56, the processing flow returns to Step 52, and Steps 52 to 54 are repeated.

In this way, by controlling the enthalpy Hc at the condenser outlet, the weight flow rate of the refrigerant to be guided to the condenser can be adjusted.

Next, automatic control of the main expansion valve will be described with reference to FIG. 8.

When automatic control of the main expansion valve is started in Step 61, a set economizer high-pressure outlet temperature Tecohset on the main circuit side is calculated (Step 62). The set economizer high-pressure outlet temperature Tecohset can be obtained from a correction value β and a compressor intermediate-suction-pressure saturation temperature MT that is obtained from a suction pressure (intermediate suction pressure) at the intermediate suction port of the two-stage turbo compressor.

Here, the correction value β used in Step 62 is a value that can be obtained from the compressor-discharge-pressure saturation temperature CT, which is obtained from the pressure at the discharge port of the two-stage turbo compressor, the compressor-suction-pressure saturation temperature ET, which is obtained from the pressure at the suction port of the two-stage turbo compressor, and the condenser exchanged-heat amount Qcon.

Then, the economizer high-pressure outlet temperature Tecoh on the main circuit side and the set economizer high-pressure outlet temperature Tecohset are compared (Step 63). If the economizer high-pressure outlet temperature Tecoh is smaller than the set economizer high-pressure outlet temperature Tecohset in Step 63, the main expansion valve is gradually opened (Step 64).

On the other hand, if the economizer high-pressure outlet temperature Tecoh is equal to or larger than the set economizer high-pressure outlet temperature Tecohset in Step 63, the processing flow advances to Step 65, and the economizer high-pressure outlet temperature Tecoh and the economizer high-pressure outlet temperature Tecohset are compared again.

If the set economizer high-pressure outlet temperature Tecohset is smaller than the economizer high-pressure outlet temperature Tecoh in Step 65, the main expansion valve is gradually closed (Step 66).

When the main expansion valve is gradually opened in Step 64, when the main expansion valve is gradually closed in Step 66, or if the set economizer high-pressure outlet temperature Tecohset is larger than the economizer high-pressure outlet temperature Tecoh in Step 65, the processing flow advances to Step 62, and Steps 62 to 63 are repeated.

In this way, by controlling the main expansion valve and the sub expansion valve according to the enthalpy Hc at the condenser outlet and the economizer high-pressure outlet temperature Tecoh, the amount of heat at the evaporator inlet can be controlled according to the amount of refrigerant circulating in the turbo refrigeration unit.

As described above, according to the turbo refrigeration unit, the control device therefor, and the control method therefor of this embodiment, the following advantages are afforded.

When the turbo refrigeration unit is operated, the control device is used, which controls the degree-of-opening of the sub expansion valve (second expansion valve) based on the economizer high-pressure outlet temperature (outlet temperature) Tecoh on the main circuit side of the economizer and which controls the degree-of-opening of the main expansion valve (first expansion valve) based on the inlet temperatures and the outlet temperatures of the heated water (first non-refrigerant) and the heat-source water (second non-refrigerant); and the suction pressure, the intermediate suction pressure, and the discharge pressure at the two-stage turbo compressor (centrifugal compressor). Thus, the amount of heat at the evaporator inlet can be controlled according to the amount of refrigerant circulating in the turbo refrigeration unit. As a result, it is possible to avoid a situation in which a liquid-phase refrigerant is discharged from the evaporator, by overheating at the evaporator outlet. Therefore, stable operation of the turbo refrigeration unit can be achieved.

Note that automatic control of the sub expansion valve and the main expansion valve of this embodiment can be PID control.

REFERENCE SIGNS LIST

1 turbo refrigeration unit
2 two-stage turbo compressor (centrifugal compressor)
2A suction port
2B discharge port
3 condenser
5 main expansion valve (expansion valve)
7 evaporator
12 heated-water pump (first-non-refrigerant pump)
16 heat-source water pump (second-non-refrigerant pump)
17 bypass circuit
18 hot-gas bypass valve (bypass-circuit control valve)

The invention claimed is:

1. A turbo-refrigeration-unit control device that controls a turbo refrigeration unit, the turbo refrigeration unit comprising:

a centrifugal compressor that compresses a refrigerant;

a condenser that condenses a high-pressure gas refrigerant through heat exchange with a first non-refrigerant supplied by a first-non-refrigerant pump;

an expansion valve that expands a liquid refrigerant derived from the condenser;

an evaporator in which the expanded liquid refrigerant evaporates through heat exchange with a second non-refrigerant supplied by a second-non-refrigerant pump;

a bypass-circuit control valve that is provided in a bypass circuit used to inject part of the high-pressure gas refrigerant compressed by the centrifugal compressor into a suction port of the centrifugal compressor and that controls the flow rate of the high-pressure gas refrigerant;

a compressor-suction-port pressure measurement unit for measuring a suction pressure of the gas refrigerant at the centrifugal compressor; and a second-non-refrigerant outlet temperature measurement unit for measuring an outlet temperature of the second non-refrigerant at the evaporator, wherein, when the turbo refrigeration unit is started-up, the expansion valve is controlled so as to be closed; the first-non-refrigerant pump and the second-non-refrigerant pump are operated; the centrifugal compressor is started-up; and then the degree-of-opening of the bypass-circuit control valve is controlled such that the temperature difference between a suction saturation temperature at the centrifugal compressor and the outlet temperature of the second non-refrigerant becomes equal to or less than a predetermined temperature difference.

2. A turbo-refrigeration-unit control device according to claim 1, wherein, when the turbo refrigeration unit is started-up, the expansion valve is controlled so as to be closed; the first-non-refrigerant pump is operated; the centrifugal compressor is started-up; the degree-of-opening of the bypass-circuit control valve is controlled; and then the second-non-refrigerant pump is operated.

3. A turbo-refrigeration-unit control device according to claim 1, the turbo refrigeration unit further comprising:

a liquid-refrigerant injection control valve that is provided in an injection circuit that is used to inject part of the liquid refrigerant into the suction port of the centrifugal compressor and that controls the flow rate of the liquid refrigerant; and a compressor-discharge-port temperature measurement unit for measuring a discharge-port temperature of the high-pressure gas refrigerant at the centrifugal compressor, wherein the degree-of-opening of the liquid-refrigerant injection control valve is controlled based on the outlet temperature at the centrifugal compressor.

4. A turbo-refrigeration-unit control device that controls a turbo refrigeration unit, according to claim 1, the turbo refrigeration unit further comprising:

an economizer that performs heat exchange between an intermediate-pressure refrigerant that has evaporated by expanding and the liquid refrigerant condensed by the condenser and that injects the intermediate-pressure refrigerant into an intermediate suction port of the centrifugal compressor;

a first-non-refrigerant flow-rate measurement unit for measuring the flow rate of the first non-refrigerant at the condenser;

a second-non-refrigerant flow-rate measurement unit for measuring the flow rate of the second non-refrigerant at the evaporator;

a first-non-refrigerant inlet temperature measurement unit for measuring an inlet temperature of the first non-refrigerant at the condenser;

a second-non-refrigerant inlet temperature measurement unit for measuring an inlet temperature of the second non-refrigerant at the evaporator;

a first-non-refrigerant outlet temperature measurement unit for measuring an outlet temperature of the first non-refrigerant at the condenser;

an economizer outlet temperature measurement unit for measuring an outlet temperature at the economizer of the liquid refrigerant that has been subjected to heat exchange with the intermediate-pressure refrigerant;

a first expansion valve that expands part of the liquid refrigerant derived from the condenser to change the part of the liquid refrigerant to the intermediate-pressure refrigerant; and a second expansion valve that expands the liquid refrigerant that has been subjected to heat exchange with the intermediate-pressure refrigerant in the economizer, wherein, after the turbo refrigeration unit is started-up, the degree-of-opening of the second expansion valve is controlled based on the outlet temperature at the economizer; and the degree-of-opening of the first expansion valve is controlled based on the flow rates of the first non-refrigerant and the second non-refrigerant, the inlet temperatures and the outlet temperatures of the first non-refrigerant and the second non-refrigerant, and the suction pressure at the centrifugal compressor.

5. A turbo refrigeration unit comprising a control device according to claim 1.

6. A control method for a turbo refrigeration unit equipped with:

a centrifugal compressor that compresses a refrigerant;

a condenser that condenses a high-pressure gas refrigerant through heat exchange with a first non-refrigerant supplied by a first-non-refrigerant pump;

an expansion valve that expands a liquid refrigerant derived from the condenser;

an evaporator in which the expanded liquid refrigerant evaporates through heat exchange with a second non-refrigerant supplied by a second-non-refrigerant pump;

a bypass-circuit control valve that is provided in a bypass circuit used to inject part of the high-pressure gas refrigerant compressed by the centrifugal compressor into a suction port of the centrifugal compressor and that controls the flow rate of the high-pressure gas refrigerant;

a compressor-suction-port pressure measurement unit for measuring a suction pressure of the gas refrigerant at the centrifugal compressor; and a second-non-refrigerant outlet temperature measurement unit for measuring an outlet temperature of the second non-refrigerant at the evaporator;

the control method comprising the steps of:

when the turbo refrigeration unit is started-up, controlling the expansion valve so as to be closed;

operating the first-non-refrigerant pump and the second-non-refrigerant pump;

starting-up the centrifugal compressor; and controlling the degree-of-opening of the bypass-circuit control valve such that the temperature difference between a suction saturation temperature at the centrifugal compressor and the outlet temperature of the second non-refrigerant becomes equal to or less than a predetermined temperature difference.

* * * * *